United States Patent [19]

Osedo

[11] Patent Number: 5,075,934

[45] Date of Patent: Dec. 31, 1991

[54] FASTENING DEVICE

[76] Inventor: Stuart S. Osedo, 98-1469 Hoohiki St., Pearl City, Hi. 96782

[21] Appl. No.: 524,723

[22] Filed: May 17, 1990

[51] Int. Cl.[5] ..... B65D 63/00

[52] U.S. Cl. ..... 24/16 R; 24/17 B; 24/442

[58] Field of Search ..... 24/16 R, 17 AP, 17 B, 24/442, 306, 447, DIG. 11; 2/DIG. 6; 128/DIG. 15

[56] References Cited

U.S. PATENT DOCUMENTS

| | | | |
|---|---|---|---|
| 85,929 | 1/1869 | Hall | 24/17 B |
| 3,112,496 | 12/1963 | Dritz | 24/17 AP |
| 3,640,273 | 2/1972 | Ray | 128/DIG. 15 |
| 4,149,540 | 4/1979 | Hasslinger . | |
| 4,701,149 | 10/1987 | Breil | 24/306 |
| 4,706,914 | 11/1987 | Ground . | |
| 4,712,766 | 12/1987 | Ehrenhalt . | |
| 4,815,172 | 3/1989 | Ward . | |
| 4,819,303 | 4/1989 | Udelhofen | 24/182 |
| 4,893,381 | 1/1990 | Frankel | 24/16 R |
| 4,939,818 | 7/1990 | Hahn | 24/16 R |

FOREIGN PATENT DOCUMENTS

| | | | |
|---|---|---|---|
| 1080653 | 8/1967 | United Kingdom | 24/442 |

*Primary Examiner*—Victor N. Sakran

*Attorney, Agent, or Firm*—Henderson & Sturm

[57] ABSTRACT

A fastening device (10) for securing a bundle of cord (101) or similar items wherein the device (10) includes two mating members (13)(14) with one mating member having a hook mating side (15) and the second mating member a loop mating side (16) captively engaged by a sleeve member (20) and wherein the mating members cooperate with one another to envelope the bundle of cord (100).

1 Claim, 1 Drawing Sheet

FIG. 1.
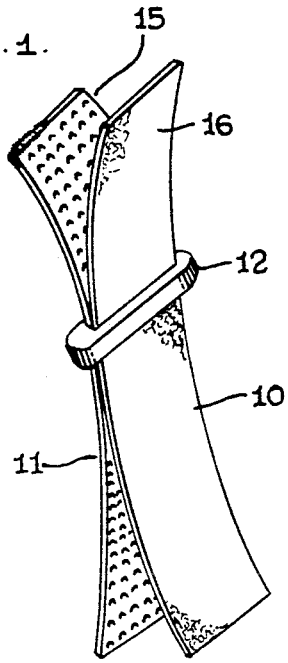
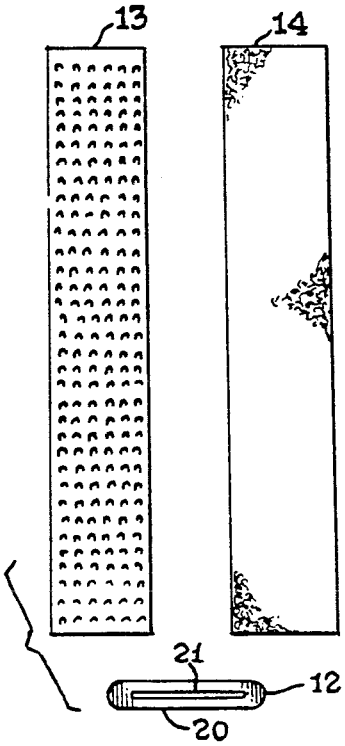
FIG. 2.
FIG. 3.
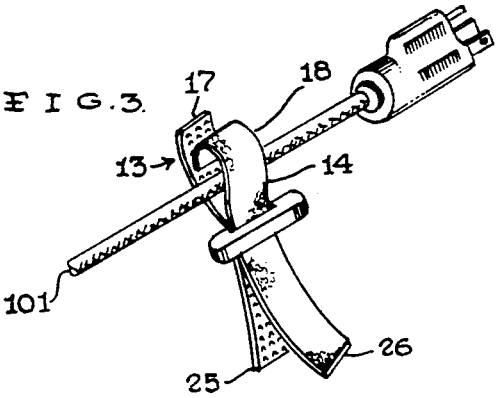
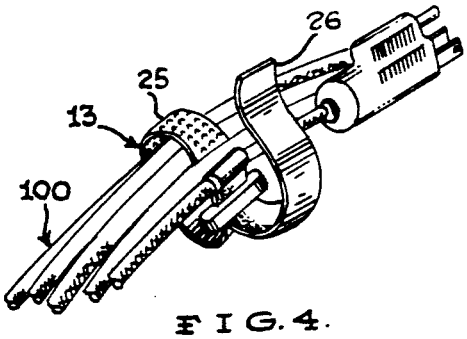
FIG. 4.
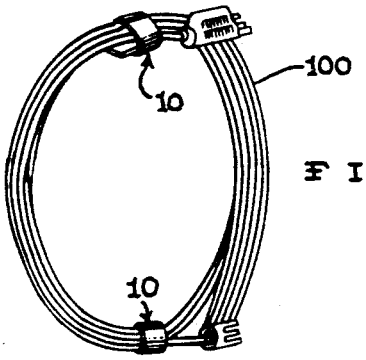
FIG. 5.

FASTENING DEVICE

TECHNICAL FIELD

This invention relates to fastening devices, and more particularly to devices for securing cords, cables, hoses or like materials in a bundled configuration.

BACKGROUND ART

This invention was the subject matter of DDP registration number 224769 which was filed in the United States Patent and Trademark Office on Apr. 18, 1989.

As can be seen by reference to the following U.S. Pat. Nos. 4,815,172; 4,706,914; 4,712,766; and 4,149,540; the prior art is replete with myriad and diverse securing devices.

While the prior art constructions are more than adequate for the basic purpose and function for which they were specially designed, they do not effectively address the specialized problem of securing a bundle of cables or cord.

U.S. Pat. No. 4,815,172 is the only prior art patent that addresses the specialized problem of securing an extension cord. However, this prior art device lacks a tightening mechanism to provide a snug fit around the extension cord.

A coiled bundle of cable or cord needs to be bound in a tight and secure manner to prevent the cable or cord from becoming tangled and damaged A cable not bound in this fashion could present a safety hazard In addition, simple logic dictates that a group of cable should also be bound in a manner that is simple and easy to use.

A need has therefore existed for a simple, reusable device that will envelope a cable in a bundled or coiled configuration in a safe and secure manner. Furthermore, this is the area where past methods of using a length of wire or string fall far short of the mark, being cumbersome, unwieldy and unsafe to use, as well as having a limited useful lifetime. This limited useful lifetime is due to the fact that string will become frayed and fragile over time and the wire will bend and break with repeated use.

These prior art devices are also not particularly well suited or adapted to hold different amounts of cord or cable effectively.

As a consequence of the foregoing situation, there has existed a longstanding need among those individuals who have encountered this particular problem in the past for simple and effective solutions to their problem. The provision of such a device to solve the problem is a stated objective of the present invention.

DISCLOSURE OF THE INVENTION

The object of this invention is to provide a device that will securely fasten a bundle of coiled or loose cable, cords, or like objects safely.

The fastening device that forms the basis of the present invention comprises in general: a connecting unit and a sleeve unit. The connecting unit comprises in general: two rectangular mating members wherein one mating member has a hook mating side and the second mating member a loop mating side.

The sleeve unit comprises in general: a narrow elongated rectangular sleeve member having an elongated slit dimensioned to receive the rectangular mating members of the connecting unit. These rectangular mating members are inserted in such a fashion that the hook mating side of the two mating members faces the back of the loop mating side.

The fastening device secures a bundle of cord or cable by wrapping the upper end of one of the mating members around one of the cords in the bundle and then wrapping the other mating member around the lone cord in such a way that the hook side of one of the mating members and loop mating side of the other mating member come in contact to form a first releasable attachment.

The sleeve unit is then slid up the mating members to cause a snug fit around the single cord. The lower end of the mating members are then wrapped around the remainder of the bundle in a fashion that causes the hook mating side and loop mating side of the mating members to come in contact to form a second releasable attachment. This particular deployment of the fastening device can be done many times on the same bundle of cord to ensure that the bundle is fastened firmly.

This fastening arrangement also allows the user to secure many different sized bundles of cords or cable with the same device due to the way in which the mating members engage. For example, for small sized bundles, the hook side and loop side of the mating members will overlap more than they would for a large bundle of cord, but the device would effectively secure both sizes of cord equally well.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is an isolated perspective view of an individual fastening device;

FIG. 2 is a disassembled side view of the fastening device;

FIG. 3 is a perspective view of the invention engaging a single cord;

FIG. 4 is an exploded perspective view of the fastening device engaging a bundle of cords; and, FIG. 5 is a perspective view of the invention in its intended environment.

BEST MODE FOR CARRYING OUT THE INVENTION

Referring now to the drawings, wherein like reference numerals designate identical or corresponding parts throughout the several views, FIG. 1 depicted the fastening device of this invention, designated generally by the reference numeral (10). The device (10) comprises in general: a connecting unit (11) and a sleeve unit (12). These units will now be described in seriatim fashion.

As can be seen by reference to FIGS. 1 and 2, the connecting unit (11) comprises two rectangular, elongated mating members (13)(14), wherein one mating member has a hook mating side (15) and the other mating member a loop mating side (16).

Still referring to FIGS. 1 and 2, it can be seen that the sleeve unit (12) comprises a narrow, elongated, rectangular sleeve member (20) provided with an elongated slit (21) for the purpose of captively receiving the two mating members (13)(14) of the connecting unit (11).

In addition, the aforementioned rectangular mating members (13)(14) are inserted through the slit (21) in the sleeve member (20) in such a fashion that the hook mating side (15) of the mating member (13) faces the back of the loop mating side (16) of mating member (14).

Referring now to FIGS. 3 and 4, it can be seen that the preferred embodiment of the fastening device (10) secures a bundle of extension cord (100) by wrapping the upper encircling mating end (18) of the second mating member (14) around a single cord (101). The upper overlapping mating end (17) of the first opposing mating member (13) is then placed over the upper encircling mating end (18) of the second mating member (14). This is done in such a way that the hook mating side (15) of the first mating member (13) and loop mating side (16) of the second mating member (14) come in contact to form a releasable attachment. The sleeve unit (12) is then slid up the mating members (13)(14) to produce a snug fit against the encircled cord (101).

The lower ends (25)(26) of the mating members (13)(14) respectively, are then wrapped around the remainder of the bundle of cord (100) in a fashion that reuses the hook mating side of mating member (13) and loop mating side of mating member (14) to form a releasable attachment.

As can be seen in FIG. 5, the preferred embodiment of this invention also contemplates the use of more than one fastening device (10) to secure a coiled bundle of cords at more than one location.

Having thereby described the subject matter of this invention, it should be apparent that many substitutions, modifications and variations of the present invention are possible in light of the above teachings. It is therefore to be understood that the invention as taught and described herein is only to be limited by the breadth and scope of the appended claims.

I claim:

1. A fastening device for captively engaging a bundle of cord consisting of:

a connecting unit including two elongated, generally flat and rectangular mating members having first and second sides with one mating member having a hook mating side and a smooth side and the other mating member having a loop mating side and a smooth side; and, a sleeve unit including a relatively thin and narrow elongated sleeve member provided with an elongated slot which is dimensioned to slideably receive said mating members; wherein, one of the mating members has an upper encircling end which is intended to at least partially surround at least one of the cords in the bundle of cord; and, wherein the other mating member has an upper overlapping end which is intended to overlap said at least one cord and the upper encircling end of the said one of the mating members to form a first releasable capture loop on one side of the sleeve member; and, wherein the other ends of the mating members are releasably engageable with one another to form a second releasable capture loop which surrounds the said first releasable capture loop for securing the bundle of cord within said device.

* * * * *